US007717703B2

(12) United States Patent
Noujaim

(10) Patent No.: US 7,717,703 B2
(45) Date of Patent: May 18, 2010

(54) COMBUSTION HEAD FOR USE WITH A FLAME SPRAY APPARATUS

(75) Inventor: Majed Noujaim, Manchester, CT (US)

(73) Assignee: Technical Engineering, LLC, Manchester, CT (US)

( * ) Notice: Subject to any disclaimer, the term of this patent is extended or adjusted under 35 U.S.C. 154(b) by 646 days.

(21) Appl. No.: 11/329,473

(22) Filed: Jan. 11, 2006

(65) Prior Publication Data

US 2006/0192026 A1 Aug. 31, 2006

Related U.S. Application Data

(60) Provisional application No. 60/656,497, filed on Feb. 25, 2005.

(51) Int. Cl.
*F23D 11/44* (2006.01)

(52) U.S. Cl. ..... 431/11; 431/12; 431/345; 239/13; 239/132; 239/132.1; 239/79; 239/83

(58) Field of Classification Search ..... 239/79–85, 239/132.3, 419.3, 422, 424.5, 427, 428, 76.11, 239/76.13, 76.16, 121.47, 121.49, 13, 8, 239/9; 427/446, 447, 448, 449, 450, 452, 427/453, 454, 455, 456; 431/11, 12, 345
See application file for complete search history.

(56) References Cited

U.S. PATENT DOCUMENTS 2,072,591 A * 3/1937 Lindquist ..... 29/890.148
RE20,425 E * 6/1937 Schori ..... 239/85
2,544,259 A * 3/1951 Caredio et al. ..... 239/79
3,433,461 A * 3/1969 Scarpa ..... 366/112
3,545,906 A * 12/1970 Foulatier et al. ..... 431/158
4,020,784 A * 5/1977 Greene ..... 116/268
4,370,538 A * 1/1983 Browning ..... 219/121.59
4,416,421 A * 11/1983 Browning ..... 239/79
4,540,121 A * 9/1985 Browning ..... 239/13
4,866,240 A * 9/1989 Webber ..... 219/121.47
4,869,936 A * 9/1989 Moskowitz et al. ..... 427/455
4,880,259 A * 11/1989 Dorge et al. ..... 285/124.3
4,911,363 A * 3/1990 Webber ..... 239/79
4,990,739 A * 2/1991 Zaplatynsky ..... 219/121.47
5,019,429 A * 5/1991 Moskowitz et al. ..... 427/422
5,135,166 A * 8/1992 Dietiker et al. ..... 239/8
5,201,550 A * 4/1993 Burkit ..... 285/109

(Continued)

*Primary Examiner*—Kenneth B Rinehart
*Assistant Examiner*—Jorge Pereiro
(74) *Attorney, Agent, or Firm*—McCormick, Paulding & Huber LLP

(57) ABSTRACT

The present invention provides an improved combustion head and combustion chamber for use with known flame spray apparatus. The combustion head includes a body portion defining a combustion opening for receiving an outlet end of the combustion chamber and an interior chamber extending from the combustion opening into the body portion. The body portion also defines a material feed conduit extending through the body portion along a longitudinal axis thereof. The body portion being substantially hollow wherein the interior chamber extends from the combustion opening throughout substantially the entire body portion including adjacent the material feed conduit. The body portion defining coolant channels on an outer surface thereof of varying depth such that the wall thickness of the body portion at the coolant channels is substantially uniform. The combustion chamber having a flange formed on an outer surface thereof for limiting insertion of the combustion chamber into the combustion head.

15 Claims, 12 Drawing Sheets

U.S. PATENT DOCUMENTS 5,206,059 A * 4/1993 Marantz ..... 427/449
5,271,965 A * 12/1993 Browning ..... 427/446
5,285,967 A * 2/1994 Weidman ..... 239/80
5,372,857 A * 12/1994 Browning ..... 427/446
5,405,085 A * 4/1995 White ..... 239/13
5,445,325 A * 8/1995 White ..... 239/132.5
5,520,334 A * 5/1996 White ..... 239/85
5,599,375 A * 2/1997 Gitman ..... 75/10.42
5,744,104 A * 4/1998 Sakurai et al. ..... 422/174
5,851,158 A * 12/1998 Winrow et al. ..... 473/330
5,932,293 A * 8/1999 Belashchenko et al. ..... 427/446
5,954,275 A * 9/1999 Honma et al. ..... 239/700
6,042,019 A * 3/2000 Rusch ..... 239/85
6,120,832 A * 9/2000 Walsh et al. ..... 427/8
6,139,913 A * 10/2000 Van Steenkiste et al. .... 427/191
6,202,939 B1 * 3/2001 Delcea ..... 239/79
6,283,386 B1 * 9/2001 Van Steenkiste et al. .... 239/427
6,392,189 B1 * 5/2002 Delcea ..... 219/121.5
6,416,877 B1 * 7/2002 Perrin et al. ..... 428/547
6,623,796 B1 * 9/2003 Van Steenkiste ..... 427/189
6,669,106 B2 * 12/2003 Delcea ..... 239/79
6,743,468 B2 * 6/2004 Fuller et al. ..... 427/191
6,811,812 B2 * 11/2004 Van Steenkiste ..... 427/189
6,824,075 B2 * 11/2004 Zimmermann ..... 239/302
6,872,427 B2 * 3/2005 Van Steenkiste et al. .... 427/455
7,108,893 B2 * 9/2006 Van Steenkiste et al. .... 427/446
7,216,814 B2 * 5/2007 Gardega ..... 239/85
7,261,556 B2 * 8/2007 Belashchenko et al. ..... 431/11
7,335,341 B2 * 2/2008 Van Steenkiste et al. ..... 422/186.04
7,351,450 B2 * 4/2008 Fuller et al. ..... 427/456
2004/0065432 A1 * 4/2004 Smith et al. ..... 165/80.2

* cited by examiner

SECTION B-B

SECTION C-C

COMBUSTION HEAD FOR USE WITH A FLAME SPRAY APPARATUS

CROSS REFERENCE TO RELATED APPLICATIONS

This application claims priority to U.S. Provisional Patent Application No. 60/656,497 filed on Feb. 25, 2005 and titled "Combustion Head For Use With A Flame Spray Apparatus". The disclosure of the Provisional Application is incorporated in its entirety herein by reference.

FIELD OF THE INVENTION

The present invention generally relates to flame spray apparatus for spraying molten or heat softened material onto a workpiece at high velocities by means of hot combustion gases. In particular, the present invention is directed to an improved combustion head and combustion chamber for use with a flame spray apparatus which together work to deliver hot combustion gases and heated coating material to the inlet of a spray nozzle of the apparatus.

BACKGROUND OF THE INVENTION

In general, flame spray apparatus operated by hot combustion gases for coating a workpiece with metal are well known in the art. For example, U.S. Pat. No. 4,416,421 to Browning (hereinafter referred to as "Browning") discloses a high velocity flame spray apparatus. The Browning apparatus includes a combustion chamber receiving at one end thereof a supply of pressurized fuel and oxygen. Ignition means, such as a spark plug, is provided to ignite the fuel. Pressurized hot combustion gases resulting from ignition of the fuel are discharged from an outlet of the combustion chamber through a plurality of ports leading to the inlet of a relatively long nozzle having a converging throat. A coating material is fed into the throat of the nozzle along the longitudinal axis of the nozzle.

The plurality of ports conveying the pressurized combustion gases from the combustion chamber to the inlet of the nozzle are radially spaced around and inclined toward the axis of the nozzle so that the hot combustion gases propel the coating material through the nozzle and also melt or at least heat-soften the material. The molten or heat-softened material exits the nozzle at high velocity and is projected onto the surface of a workpiece thereby to provide the workpiece with a coating of the material. Passageways for cooling water are provided around the exterior of the nozzle.

A commercial embodiment of the flame spray apparatus disclosed in the Browning patent includes a combustion head which is provided as a transition piece between the outlet of the combustion chamber and the inlet end of the nozzle. The combustion head defines a counterbore which receives the hot combustion gases from the combustion chamber.

One known problem associated with the combustion head of the Browning flame sprayer is that a floor of the counterbore receiving the hot combustion gases from the combustion chamber cracks and erodes after a short period of use, thus, severely limiting the useful life of the combustion head. Such cracking and erosion occurs due to the development of local hot spots in the counterbore and thermal fatigue of the body of the combustion head adjacent to the counterbore.

U.S. Pat. No. 4,911,363 to Webber (hereinafter referred to as "Webber") discloses an improved combustion head for use with flame spray apparatus such as those described in the Browning patent. The Webber patent discloses a combustion head that defines a recess in the floor of the counterbore which receives the continuous flow of hot pressurized combustion gases from the combustion chamber of the flame spray apparatus. The depth of the recess being sufficient to redistribute the heat of the combustion gases to prevent local hot spots in the counterbore. The recess is provided to avoid cracking and erosion in the combustion head by reducing thermal fatigue which occurs in cyclic use of the flame spray apparatus. Similar to the Browning device, the Webber combustion head also provides a plurality of inclined passages for transporting the combustion gases from the combustion chamber to the inlet of the nozzle of the flame spray apparatus.

In use, the Webber combustion head is coupled to a combustion chamber wherein an open end of the combustion chamber extends into and is fully inserted into the counterbore of the combustion head engaging the floor of the counterbore.

Additionally, the Webber combustion head defines a plurality of radially spaced recesses or channels extending longitudinally along the length of the outer surface of the combustion head through which water is passed for cooling the combustion head.

One disadvantage associated with the above-identified prior art combustion heads is that the floor of the counterbore, even with the recess therein as disclosed by Webber, includes a substantial mass of material which receives the hot combustion gases from the combustion chamber and is therefore susceptible to cracking due to the expansion and contraction of the combustion head during the heating and cooling thereof. The mass of the floor of the counterbore also adds to the overall mass of the combustion head thereby contributing to the thermal fatigue of the combustion head over the life thereof due to the cyclic operation of flame spray apparatus under high temperatures.

Additionally, combustion gases contacting the floor of the counterbore cause the floor of the counterbore to erode enlarging the inlets of the combustion gas passages adjacent the counterbore resulting in an uneven flow of gases through the gas passages of the combustion head. Thus, the pressure of the combustion gases conveyed through each of the plurality of inclined gas conduits is not constant therebetween. This uneven pressure in the inclined gas conduits causes the coating material entering the nozzle of the apparatus to be pushed towards the side of the throat of the nozzle opposite the inclined gas conduits with the greatest pressure which causes erosion of the throat of the nozzle and shortens the useful life thereof.

Accordingly, the cracking and erosion of the floor of the counterbore present in the above-describe prior art combustion heads limits the useful life of the combustion head and parts associated therewith.

The floor of the counterbore in the above-identified prior art combustion heads also obstructs the flow of combustion gases entering the combustion head thereby increasing the amount of turbulence associated with the combustion gases entering the combustion head. This turbulence increases the occurrence of uneven erosion, cracking and wear of the material of the combustion head. Additionally, uneven pressure in the gas conduits exiting the interior chamber of the combustion head is increased due to the disrupted flow of the combustion gases entering the combustion head. Thus, the presence of the floor of the counterbore reduces the overall life of the above-identified prior art combustion heads.

Another disadvantage of the above-identified prior art combustion heads, is that a seal provided to retain coolant within a housing of the flame spray apparatus and disposed between the housing in which the combustion head is used in assembly therewith and a material feed passage of the combustion head often fails due to overheating under heavy use conditions. Typically, failure of this seal causes a shut down of a coating operation in which the flame spray apparatus is being used so that the seal can be replaced. The Webber combustion head includes coolant channels extending longitudinally along the length of the outer surface of the combustion head through which water is passed for cooling the combustion head. However, the coolant channels disclosed by Webber do not effectively maintain the inlet to the material feed passage and the seal disposed between the material feed passage and the housing of the flame spray apparatus at an operating temperature low enough to avoid the seal from failure due to heat damage under heavy use conditions.

Based on the foregoing, it is the general object of the present invention to provide an improved combustion head and combustion chamber for use with known flame spray apparatus that improves upon, or overcomes the problems and drawbacks associated with prior art combustion heads.

SUMMARY OF THE INVENTION

The present invention provides an improved combustion head and combustion chamber for use with known flame spray apparatus. The combustion head includes a body portion defining a combustion head opening for receiving an outlet end of the combustion chamber and an interior chamber extending from the combustion head opening into the body portion. The body portion also defines a material feed conduit extending through the body portion along a longitudinal axis thereof. The longitudinal axis extending generally perpendicular to the combustion head opening. The material feed conduit having an inlet and an outlet defined by first and second opposing sidewalls or ends of the body portion respectively. The inlet and outlet of the material feed conduit being aligned concentric with longitudinal axis of the body portion.

The interior chamber extends into the body portion on opposing sides of the material feed conduit and is defined in part by arcuate interior sidewalls of the body portion. The body portion being substantially hollow wherein the interior chamber extends from the combustion opening throughout substantially the entire body portion including adjacent the material feed conduit. The floor of the counterbore present in prior art combustion heads is eliminated in the present invention. The elimination of the floor of the combustion head reduces the total mass of the present invention combustion head relative to the prior art devices. Accordingly, the occurrence of cracking and erosion of the combustion head especially at the floor of the counterbore that is present in the prior art combustion heads discussed hereinabove is greatly reduced in the combustion head of the present invention. Additionally, elimination of the floor of the counterbore reduces the turbulence in the flow of combustion gases entering the combustion head as will be discussed further below.

The combustion head also includes a plurality of cooling channels defined by an outer surface of the body portion extend through the length of the body portion. The cooling channels are spaced radially about the longitudinal axis of the body portion. Each of the cooling channels having a varying depth along the length thereof defining an arc corresponding to the arcuate sidewalls of the interior chamber such that the sidewalls of the body portion formed between the interior chamber and the plurality of cooling channels are substantially uniform in wall thickness adjacent the interior chamber. The relative uniformity of wall thickness of the combustion head at the cooling channels allows for increased uniformity in the operating temperature over the entire mass of the combustion head during the use thereof than prior art combustion heads. Thus, the cooling channels of the present invention combustion head and the relatively uniform wall thickness formed in part thereby, help to reduce the occurrence of stress fractures in the combustion head due to thermal fatigue and thereby increase the overall life of the combustion head.

The present invention combustion head further includes a plurality of combustion gas conduits extending from the interior chamber through the second end of the body portion. In a preferred embodiment of the present invention combustion head, the gas conduits are arranged radially about the material feed conduit and extend through the second end of the body portion converging towards the material feed conduit throughout a length thereof. The gas conduits transport hot combustion gases from the interior chamber into an inlet of a nozzle coupled to the body portion adjacent the second end of the body portion.

An improved combustion chamber is also provided for assembly with the combustion head disclosed herein. The combustion chamber having an inlet and an outlet at opposed ends thereof. The inlet for receiving a supply of pressurized fuel and oxygen. Ignition means, such as a spark plug is provided to ignite the fuel as set forth in both the Browning and Webber patents. The combustion chamber includes a flange formed on an outer surface thereof near the outlet end thereof. The flange for engaging a surface of the combustion head surrounding the combustion head opening and limiting the insertion of the combustion chamber into the interior chamber of the combustion head. The restricted insertion of the combustion chamber into the combustion head opening provides that the outlet of the combustion chamber remains spaced apart from the outer surface of the material feed conduit when the combustion chamber is engaged with the combustion head and during use thereof in a flame spray apparatus.

One advantage of the present invention combustion head and combustion chamber assembly is that the combustion head includes a substantially less amount of material mass as compared to prior art combustion heads. In the prior art combustion heads, the floor of the counterbore was designed to engage the outlet end of the combustion chamber and support the same thereby in part establishing the proper insertion of the combustion chamber into the combustion head. Whereas, in the present invention, the floor of the counterbore is eliminated and the insertion position of the combustion chamber into the combustion head is established and supported by the flange on the outer surface of the combustion head engaging a flat surface on a lower side of the combustion head. The flange eliminates the need for the combustion chamber to abut against the floor of the combustion head, thereby allowing the floor of the counterbore to be eliminated. As set forth above, elimination of the floor of the counterbore results in a substantially larger interior chamber of the combustion head when compared to the prior art. Further, the elimination of the floor of the counterbore in the present invention, results in the material mass present in the body portion of the combustion head being significantly less than that of prior art combustion heads. When compared to prior art combustion heads, the reduction in the amount of material mass inside the combustion head allows it to operate at a reduced temperature, thereby greatly reducing the occurrence of a failure of the combustion head due to thermal stress and fatigue in the body of the combustion head caused by thermal expansion of the material mass thereof.

The foregoing and still other objects and advantages of the present invention will be more apparent from the following detailed explanation of the preferred embodiments of the invention in connection with the accompanying drawings wherein throughout the figures, like reference numerals describe like elements of the invention.

BRIEF DESCRIPTION OF THE DRAWINGS

FIG. 13 shows a sectional view taken at the line C-C of FIG. 14.

DETAILED DESCRIPTION OF THE INVENTION

Figure 1:
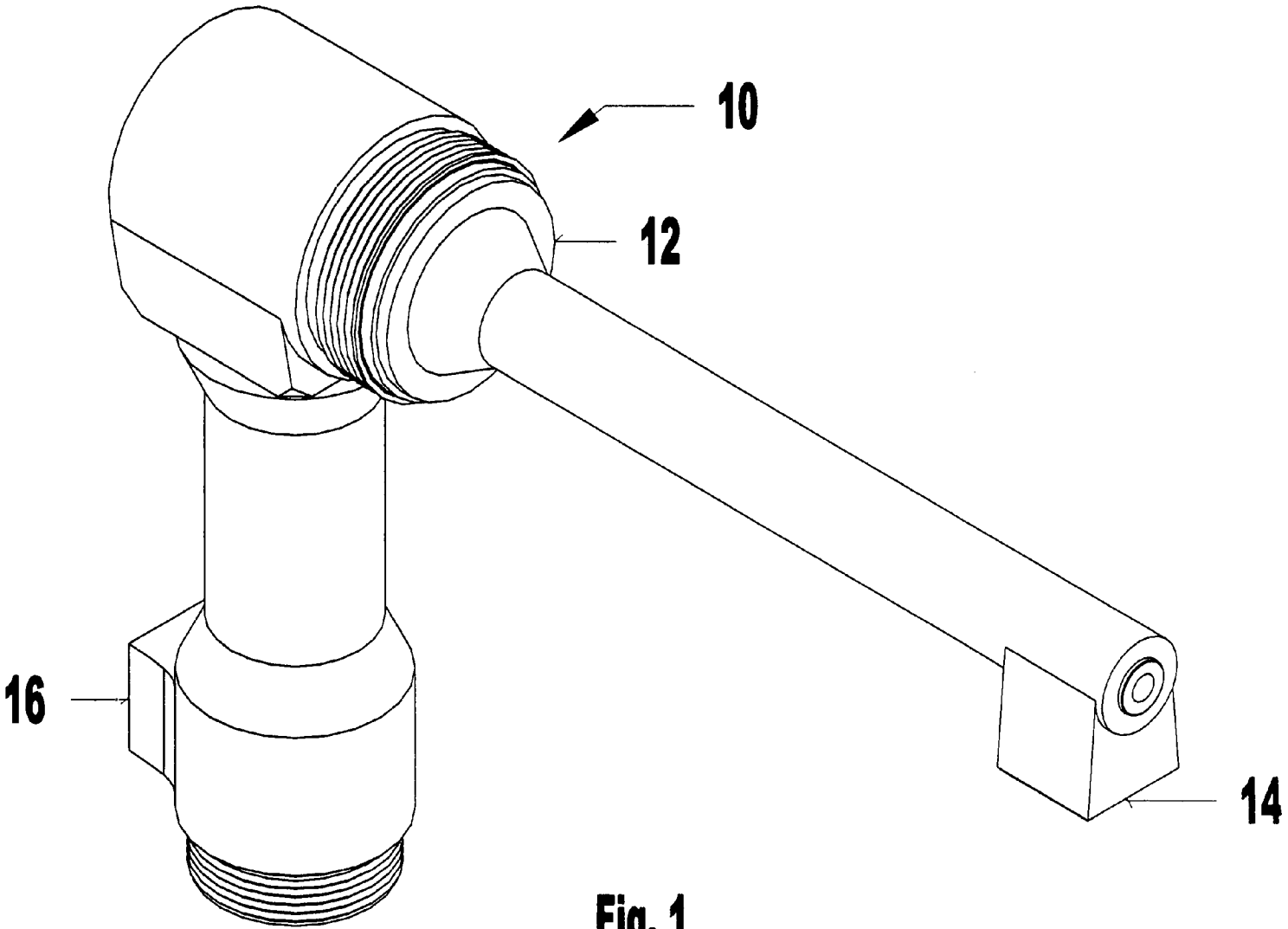
FIG. 1 is a perspective view of a typical flame spray apparatus employing a combustion head and combustion chamber in accordance with the present invention.

Referring to the FIG. 1, the present invention combustion head and combustion chamber are designed for use with a typical flame spray apparatus, generally referred to with the reference numeral 10. The flame spray apparatus 10 includes a housing 12. The housing 12 includes a coolant inlet 14 and outlet 16 for cooling the apparatus 10 as well as the combustion head and combustion chamber as shown in FIG. 2 and referenced generally by reference numerals 18 and 20 respectively.

Figure 2:
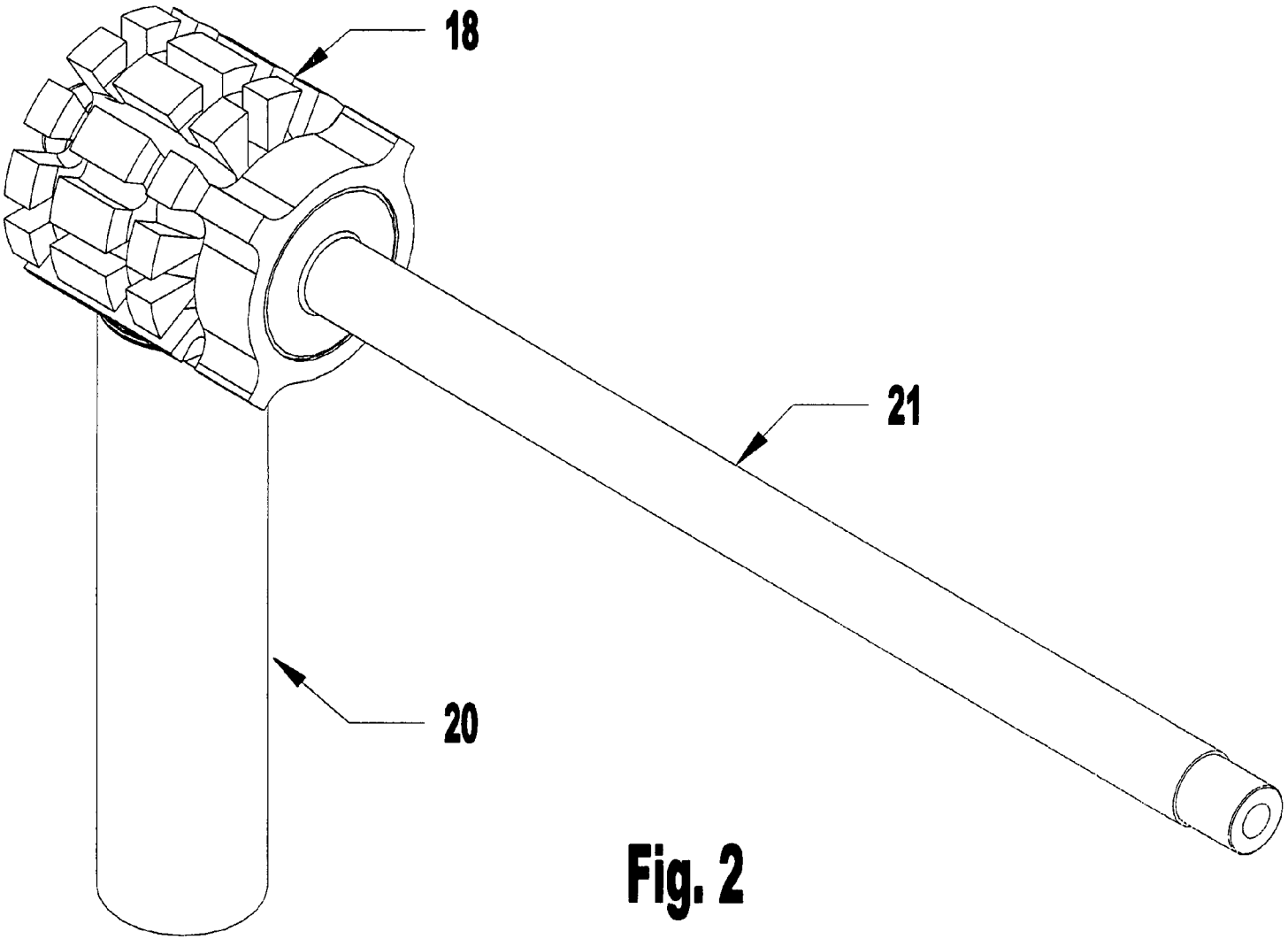
FIG. 2 is a perspective view of the combustion head and combustion chamber of the present invention shown coupled to a prior art nozzle and as used in the flame spray apparatus of FIG. 1.
Figure 3:
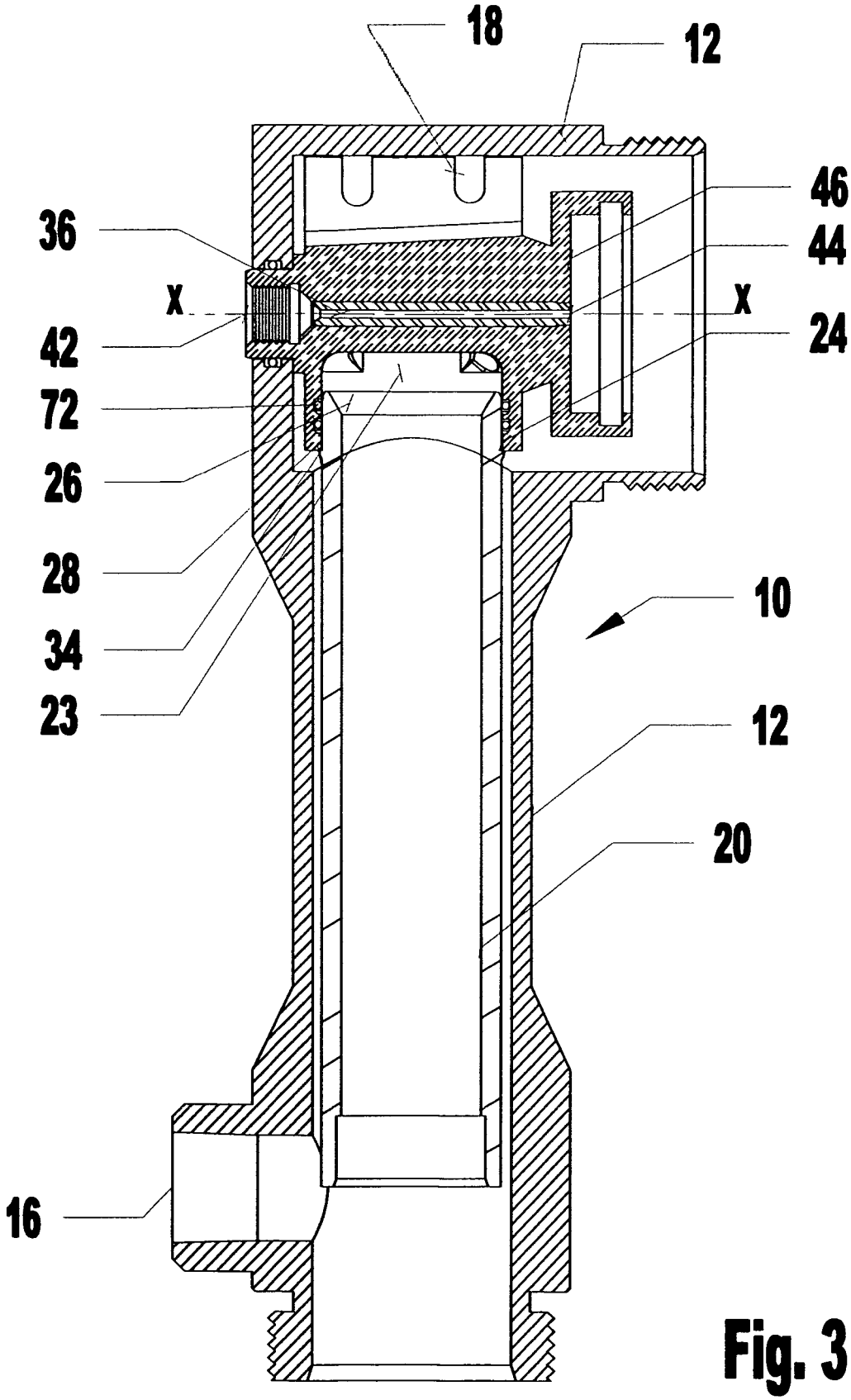
FIG. 3 is a partial cross sectional side view of the flame spray apparatus of FIG. 1 including the combustion head and the combustion chamber of the present invention mounted therein.

As shown in FIG. 2, the combustion head 18 and combustion chamber 20 of the present invention are coupled together as set forth in detail following. A nozzle 21 is also coupled to the combustion head forming an assembly for use in a flame spray apparatus 10. FIG. 3 illustrates the combustion head 18 and combustion chamber 20 of the present invention coupled together and mounted in the housing 12 of the flame spray apparatus 10.

Referring to FIGS. 3-11, the combustion head 18 includes a body portion 19 having a bottom wall 22 defining a combustion head opening 24 therethrough. The combustion head opening 24 is in fluid communication with an outlet 26 of the combustion chamber 20 and an interior chamber 23 defined by the body portion 19 of the combustion head 18. The combustion chamber 20 includes an outlet end 28 received in the combustion head opening 24 thereby coupling the combustion chamber to the body portion 19.

The body portion 19 further defines a pair of circular recesses 30, 30 extending outwardly from the combustion head opening 24 for supporting a pair of corresponding O-rings 32, 32 engageable with the outlet end 28 of the combustion chamber. The O-rings 32, 32 seal the joint between the outlet end 28 of the combustion chamber 20 and the interior chamber 23 of the combustion head 18. Although, two O-rings are utilized in the illustrated embodiment of the present invention, in other embodiments, only one O-ring or other type of seal known to one skilled it the art may be employed.

Figure 14:
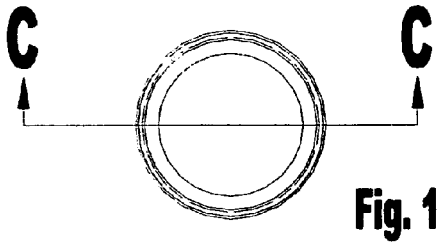
FIG. 14 is a top view of the combustion chamber of FIG. 12.
Figure 12:
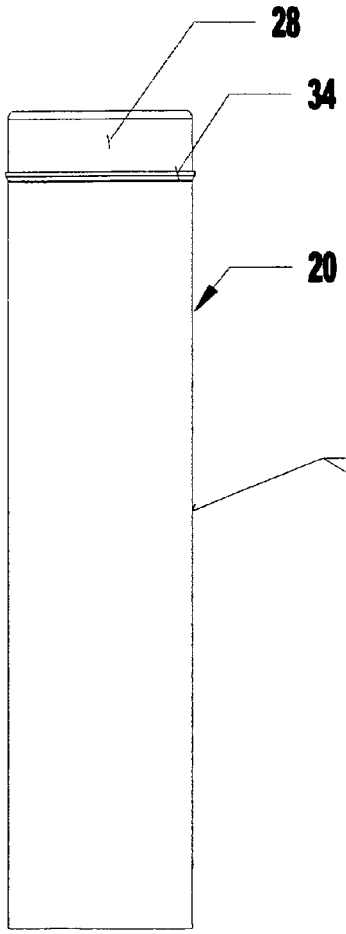
FIGS. 12 and 13 are elevation side and sectional views respectively of a combustion chamber in accordance with the present invention.
Figure 13:
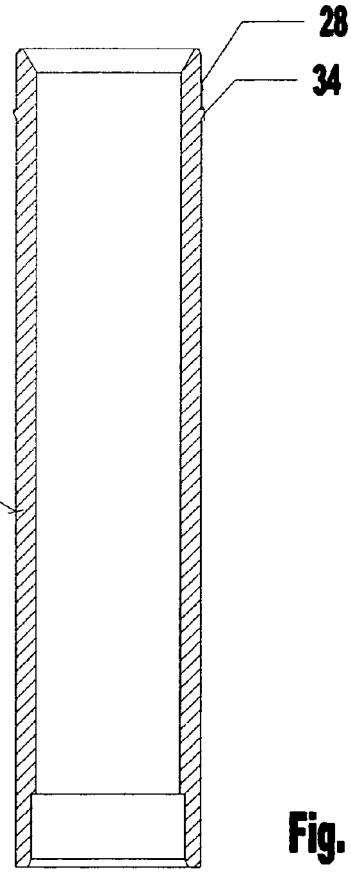

The combustion chamber 20 includes a flange 34 extending outwardly from an outer surface of the combustion chamber 20 which limits the insertion of the outlet end 28 of the combustion chamber into the combustion head opening 24 and interior chamber 23 of the combustion head. Referring to FIGS. 12 and 13, in a preferred embodiment, the flange 34 is formed by turning the outlet end 28 of the combustion chamber 20 and the body 35 of the combustion chamber down to a smaller diameter than the flange 34. The flange 34 could also be formed on the outer surface of the combustion chamber 20 using other methods know to one skilled in the art. FIG. 14 illustrates a top view of the combustion chamber 20 and flange 34 in accordance with the present invention.

Figure 7:
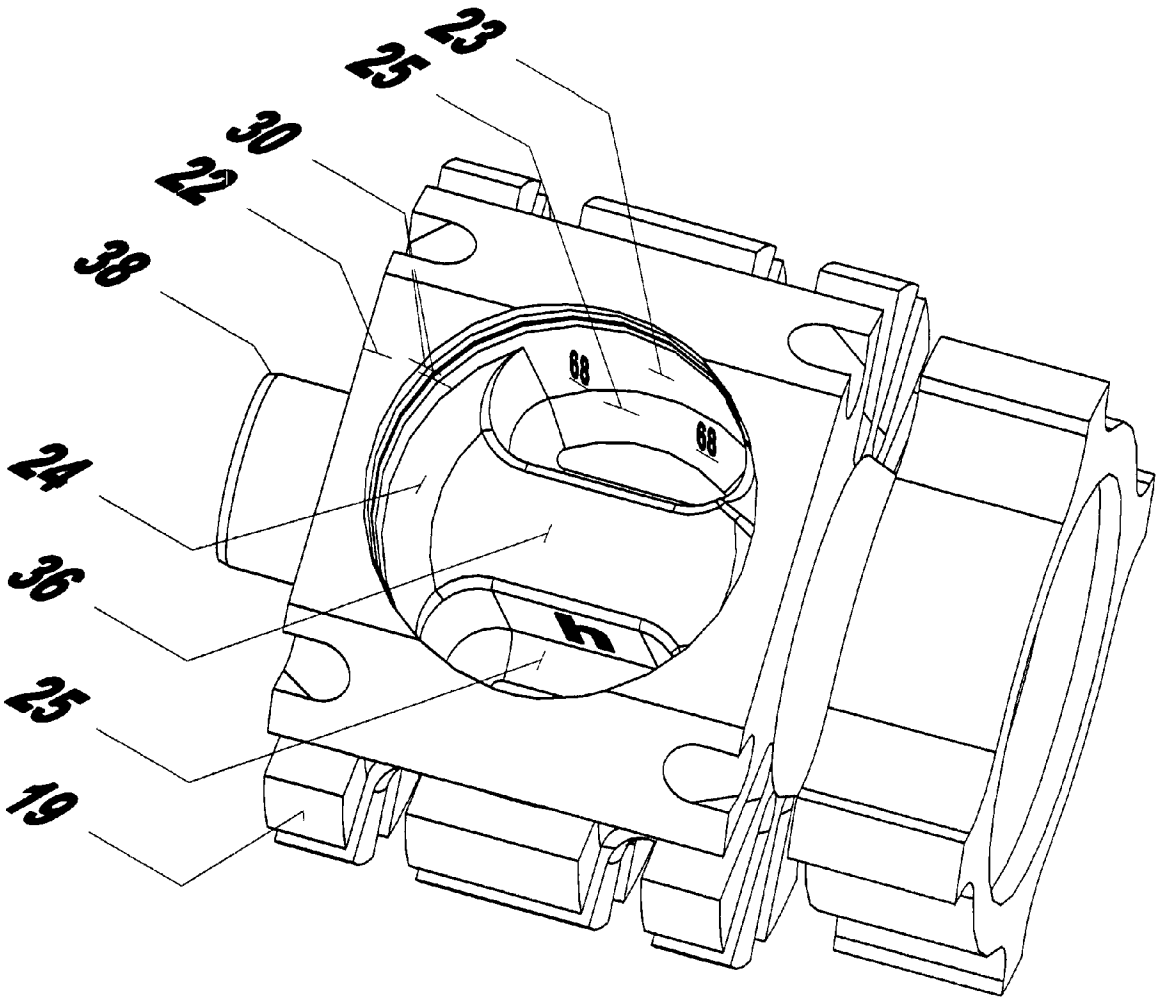
FIG. 7 is a perspective view of the combustion head of FIG. 4 showing the combustion head opening and interior chamber thereof.
Figure 8:
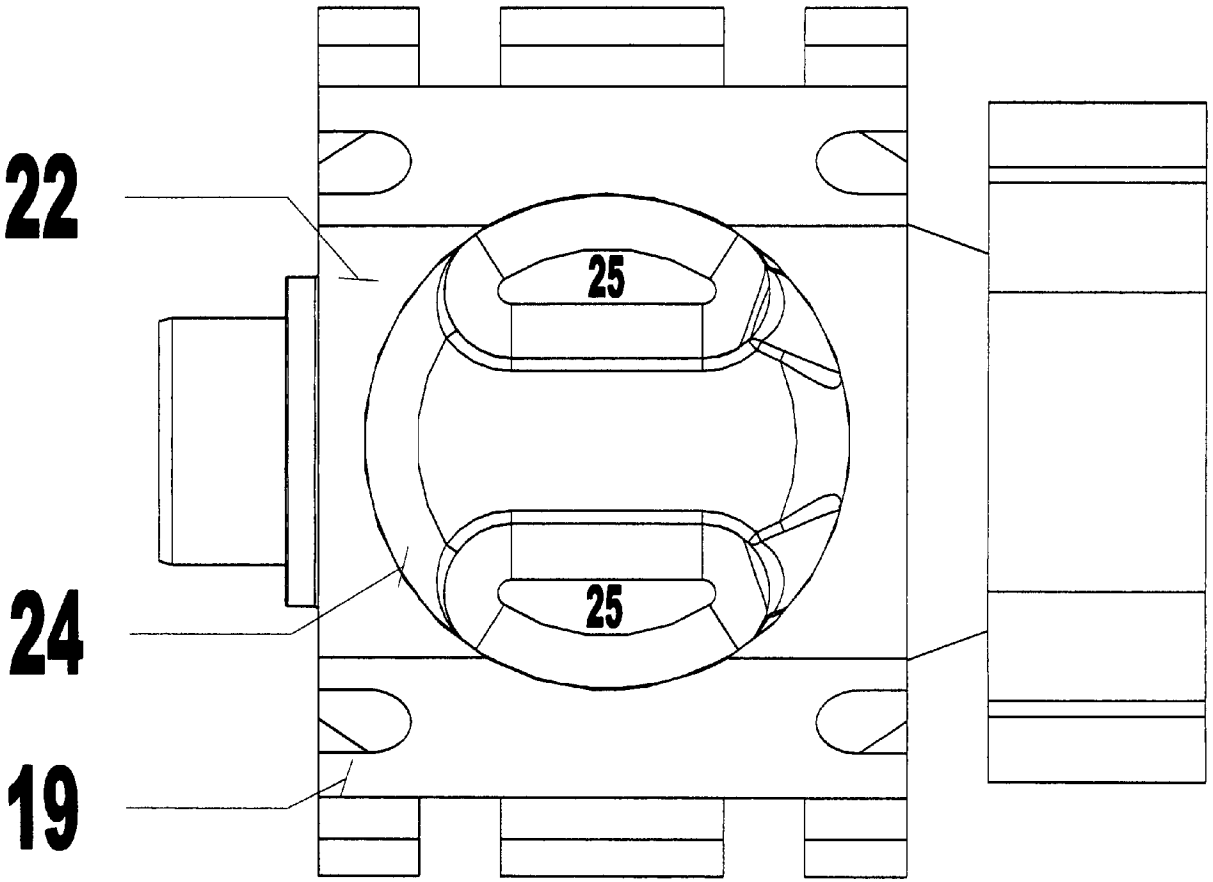
FIG. 8 is a bottom view of the combustion head of FIG. 4 showing the combustion head opening and interior chamber thereof.

Referring to FIG. 7, the bottom wall 22 of the combustion head is substantially flat engageable with the flange 34 of the combustion head. The flat bottom wall 22 provides for ease of insertion of the combustion chamber 20 into the combustion head opening 24 while both of the combustion head 18 and combustion chamber are disposed in housing 12 as the joint therebetween is viewable through a nozzle opening of the housing 12. The ability to view the engagement between the flange 34 and the bottom wall 22 of the combustion head 18 inside of the housing 12 also allows a user to confirm that the combustion chamber is properly coupled to the combustion head. This constitutes a further improvement in the present invention combustion head when compared to that disclosed by Webber. In the Webber combustion head, the lower surface adjacent the combustion opening is round such that the joint between the combustion chamber and the combustion head is not viewable when the combustion head and chamber are installed in the housing of a typical flame spray apparatus.

Figure 6:
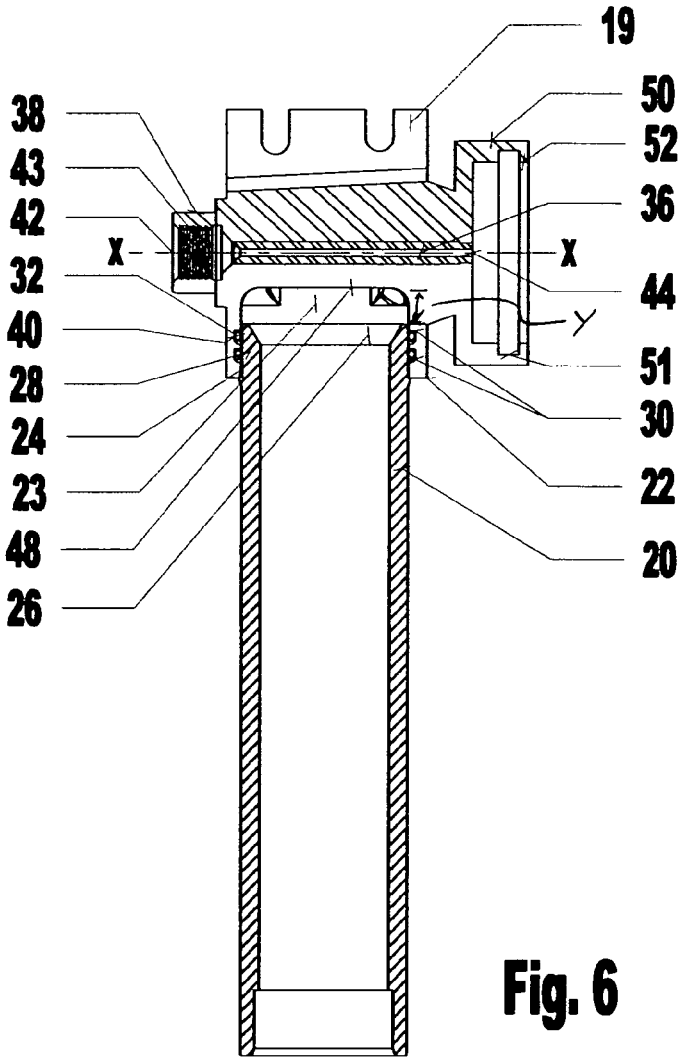
FIG. 6 is a cross-sectional view of the combustion head and combustion chamber of FIG. 5 taken at line B-B of FIG. 5.

The combustion head 18 further defines a material feed conduit 36 extending through the length of the body portion 19 along a longitudinal axis X-X of the body portion. (See FIGS. 3 and 11). The material feed conduit 36 includes an end portion 38 extending outwardly from a first end 40 of the body portion 19 and defining an inlet 42 of the material feed conduit. As shown in FIG. 6, the inlet 42 includes a threaded opening 43 wherein a material feed supply line (not shown) is coupled to the combustion head 18 during use of the apparatus 10. An outlet 44 of the material feed conduit 36 is defined by a second end 46 of the body portion 19. The outlet 44 of the material feed conduit 36 is in fluid communication with an inlet of the nozzle 21 when the combustion head 18 is coupled to a nozzle 21 as shown in FIG. 2.

Referring to FIG. 7, the interior chamber 23 of the body portion 19 includes areas 25, 25 extending into the body portion on opposing sides of the material feed conduit 36 and substantially throughout a height h of an outer surface of the material feed conduit. The interior chamber 23 being in fluid communication with the outlet 26 of the combustion chamber 20 functions as an extension of the combustion chamber for receiving combustion gases discharged therefrom.

Figure 9:
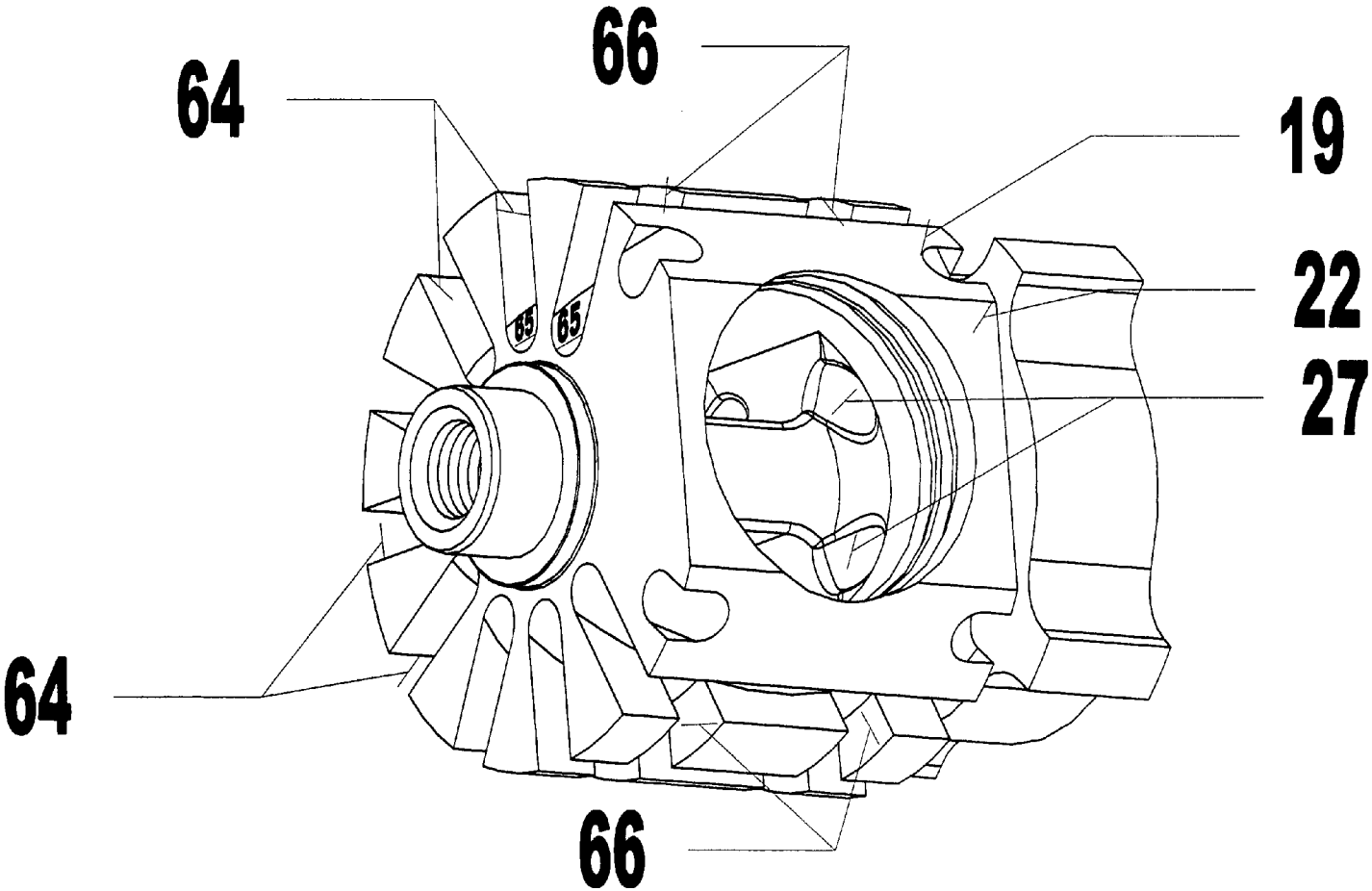
FIG. 9 is a perspective view of the combustion head of FIG. 4 showing the combustion head opening and interior chamber thereof.

As shown in FIG. 7, apart from the material feed conduit 36, the interior chamber 23 occupies nearly the entire interior area of the body portion 19. Thus, combustion gases discharged from the combustion chamber 20 flow substantially undisturbed into the interior chamber 23 of the combustion head 18 and exit through a plurality of gas conduits 27 (FIG. 9). In contrast to the above-identified prior art combustion heads, the present invention combustion head 18 does not include a counterbore having a floor wherein the floor of the counterbore receives a portion of the combustion gases discharged from the outlet of the combustion chamber 20. In the prior art combustion heads, the floor of the counterbore is provided in part to engage the outlet end of the combustion chamber and provide support to the same. Additionally, the floor provides additional mass to retain the heat of the combustion head. However, the mass of the floor of the counterbore present in prior art combustion heads adds to the overall mass of the combustion head thereby increasing the occurrence of erosion and cracks in the combustion head due to thermal fatigue of the material thereof.

Figure 11:
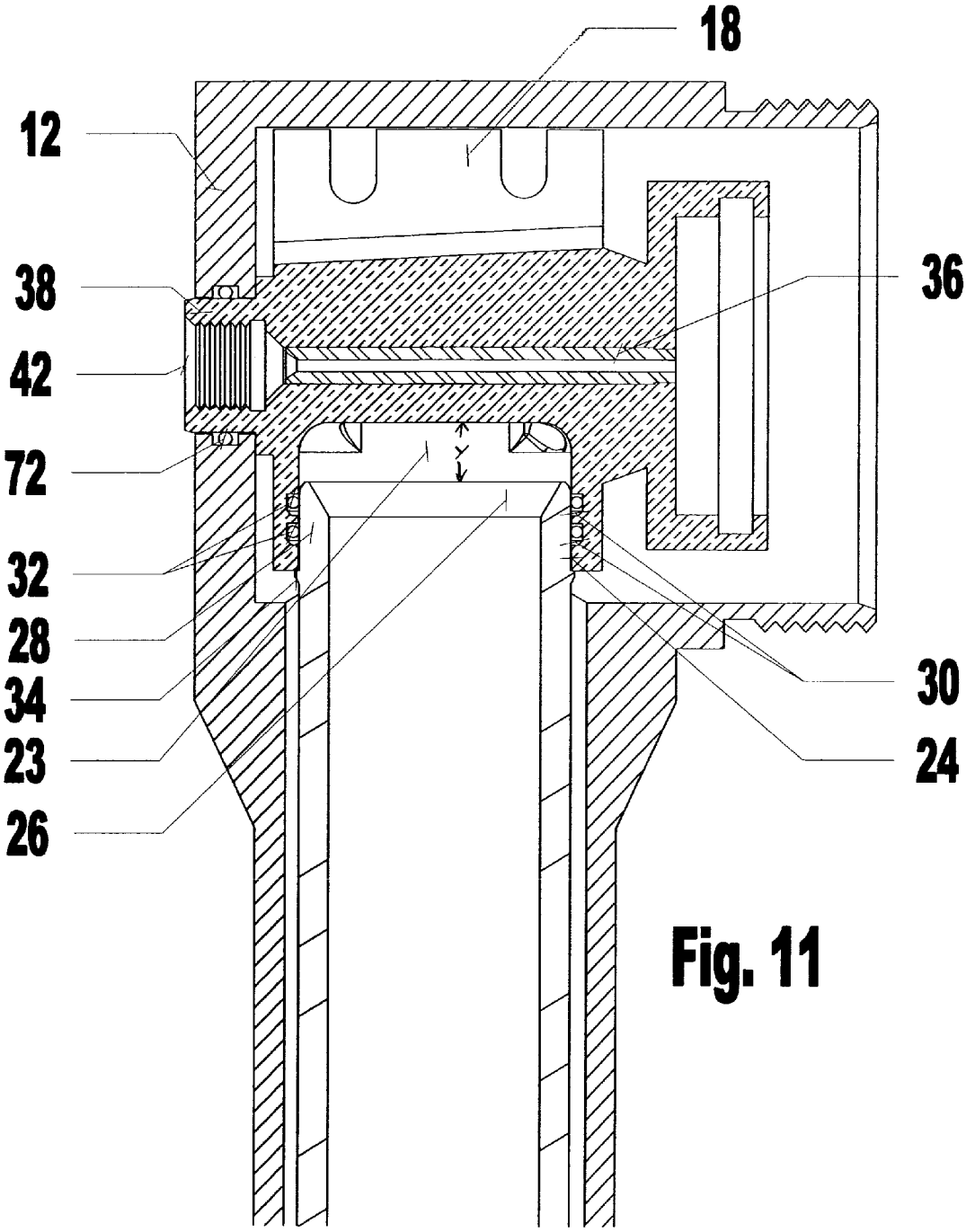
FIG. 11 is an enlarged sectional view of the combustion head of FIG. 4 in assembly with a combustion chamber of the present invention, and mounted in a flame spray apparatus.

As shown in FIGS. 6 and 11, the combustion head 18 in accordance with the present invention includes the combustion head opening 24 which provides an unobstructed opening to the interior chamber 23 of the body portion 19. Further, as set forth above, the flange 34 of the combustion chamber limits the insertion of the combustion chamber into the interior chamber 23 such that the outlet end 28 of the combustion chamber remains spaced apart a distance Y from an outer surface 48 of the material conduit 36. Accordingly, the combustion gases entering the interior chamber 23 pass unobstructed from the combustion chamber 20 through the combustion head opening 24 and into the interior chamber 23 and extended areas 25, 25 of the interior chamber surrounding the material feed conduit 36. Thus, in the combustion head 18 of the present invention, the combustion gases entering the interior chamber 23 of the body portion 19 are evenly dispersed throughout the interior chamber and about the outer surface of the material feed conduit 36 and therefore uniformly heat the material feed conduit throughout the length of the body portion 19 of the combustion head.

Additionally, in the present invention combustion head 18, the mass of material forming the floor of the counterbore that is present in prior art combustion heads is eliminated, thereby reducing the overall mass of the combustion head. This reduction in the overall mass of the combustion head reduces the occurrence of cracking and erosion of the combustion head due to thermal fatigue of the material of the combustion head caused by the heating and cooling of the combustion head during the cyclic use thereof. Thus, due to the elimination of the floor of the counterbore, and reduced mass resulting therefrom, the present invention combustion head 18 has a longer useable life when compared with that of the above-identified prior art combustion heads.

The presence of the flange 34 on the combustion chamber 20 along with the absence of the floor of the counterbore in the combustion head 18 of the present invention render both the combustion head 18 and the combustion chamber 20 not useable interchangeably with corresponding prior art devices including the Webber device.

Figure 4:
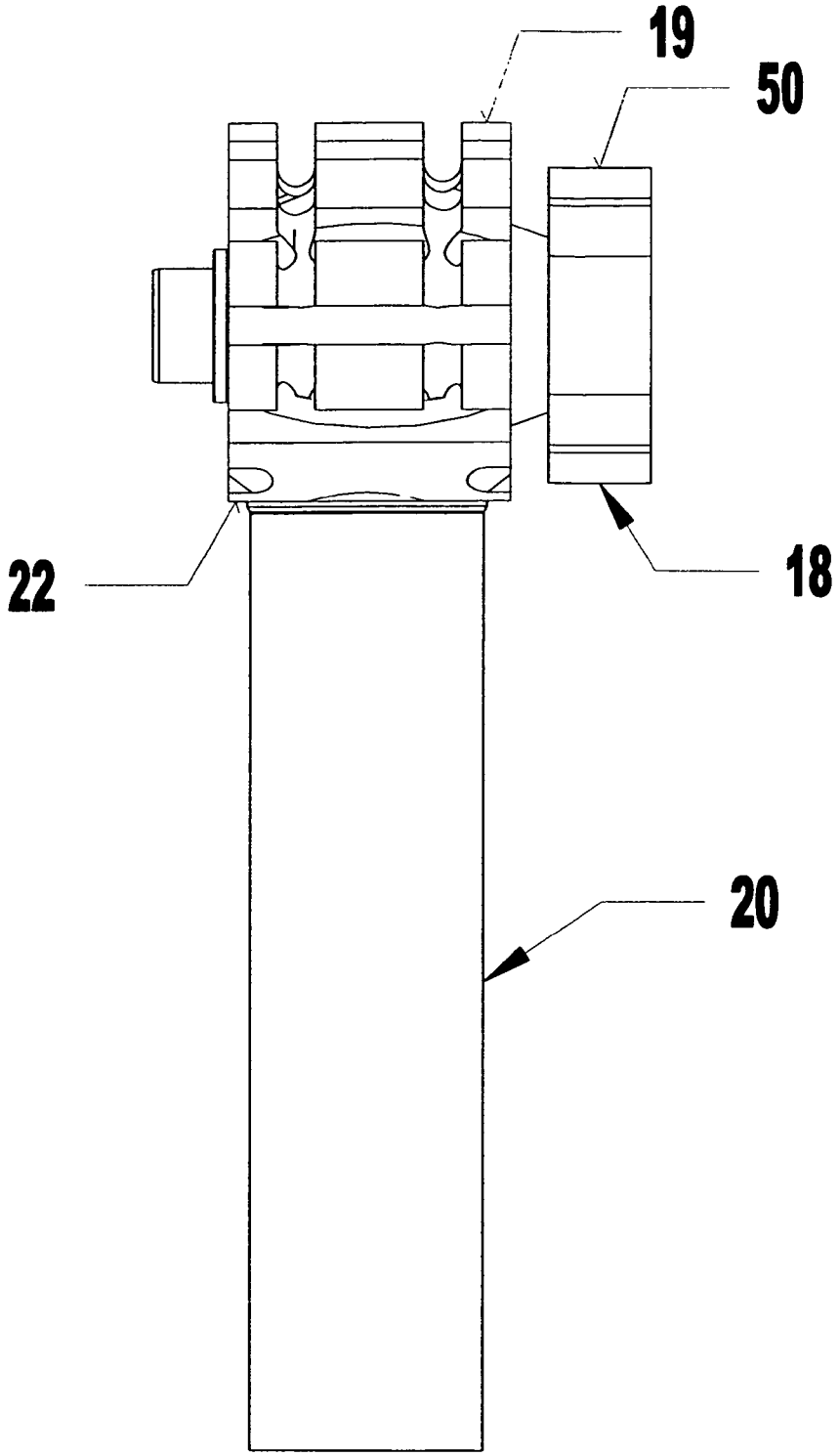
FIG. 4 is side elevational view of a combustion head and combustion chamber according to the present invention.
Figure 5:
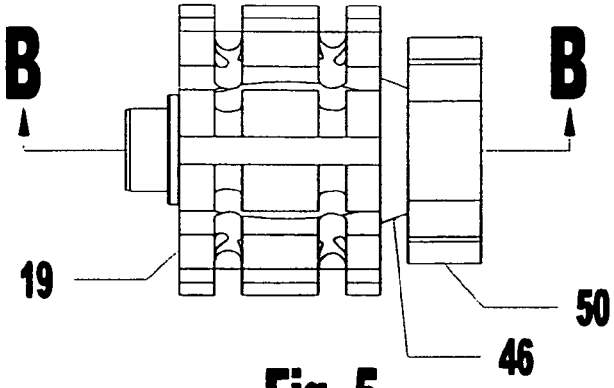
FIG. 5 is a top view of the combustion head and combustion chamber of FIG. 4.

Referring to FIGS. 4, 5 and 6, a spray nozzle flange 50 is coupled to the second end 46 of the body portion 19 of the combustion head 18. The spray nozzle flange 50 defines an opening 52 on a side opposite the second end 46 for receiving an inlet portion 56 of a nozzle 21 therein. The spray nozzle flange 50 defines a recess 51 surrounding the opening 52 for receiving a seal for sealing the coupling between an inlet of the spray nozzle 21 and the spray nozzle flange 50.

Figure 10:
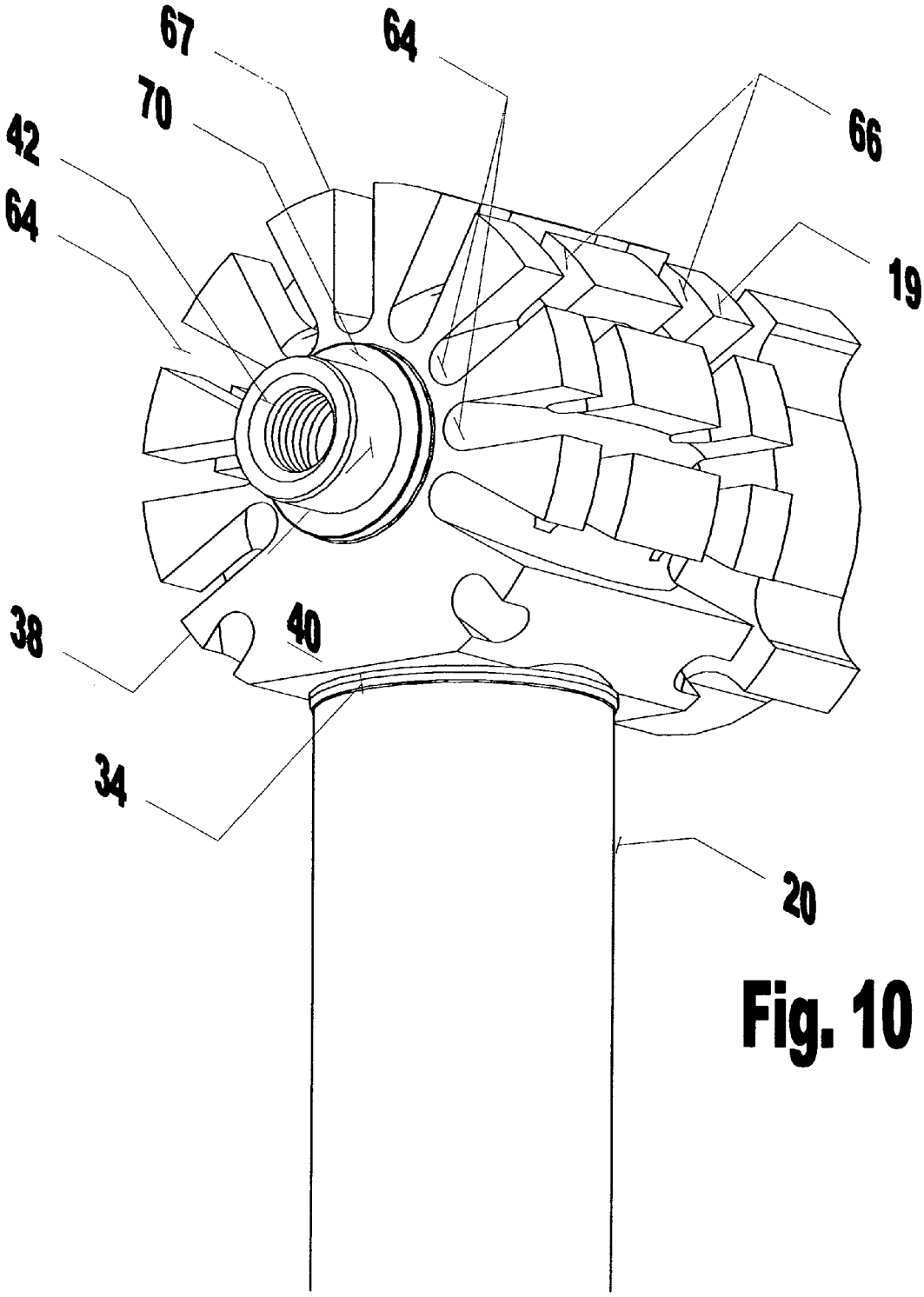
FIG. 10 is an enlarged of the combustion head of FIG. 4 shown mounted to a combustion chamber in accordance with the present invention.

Referring now to FIGS. 9 and 10, the body portion 19 defines a plurality of intersecting coolant channels including longitudinal coolant channels 64 and circumferential coolant channels 66 on the outer surface thereof for transporting coolant adjacent to the body portion for cooling the combustion head 18 during use of the flame spray apparatus 10. As shown in FIG. 1, the housing 12 of the flame spray apparatus 10 includes a coolant inlet 14 and outlet 16 for cooling the apparatus including the combustion head 18 during use thereof. The plurality of longitudinal coolant channels 64 are spaced apart radially about the longitudinal axis X-X of the body portion 19 and extend throughout the length of thereof. Each of the cooling channels 64 having a varying depth along the length thereof defining an arc 65 corresponding to the arcuate sidewalls 68 of the interior chamber 23 and extended portions 25, 25 thereof, (See FIGS. 7 and 9) such that the sidewalls of the body portion 19 formed between the interior chamber and the plurality of cooling channels 64 are substantially uniform in wall thickness adjacent the interior chamber throughout the length of the body portion.

Figure 15:
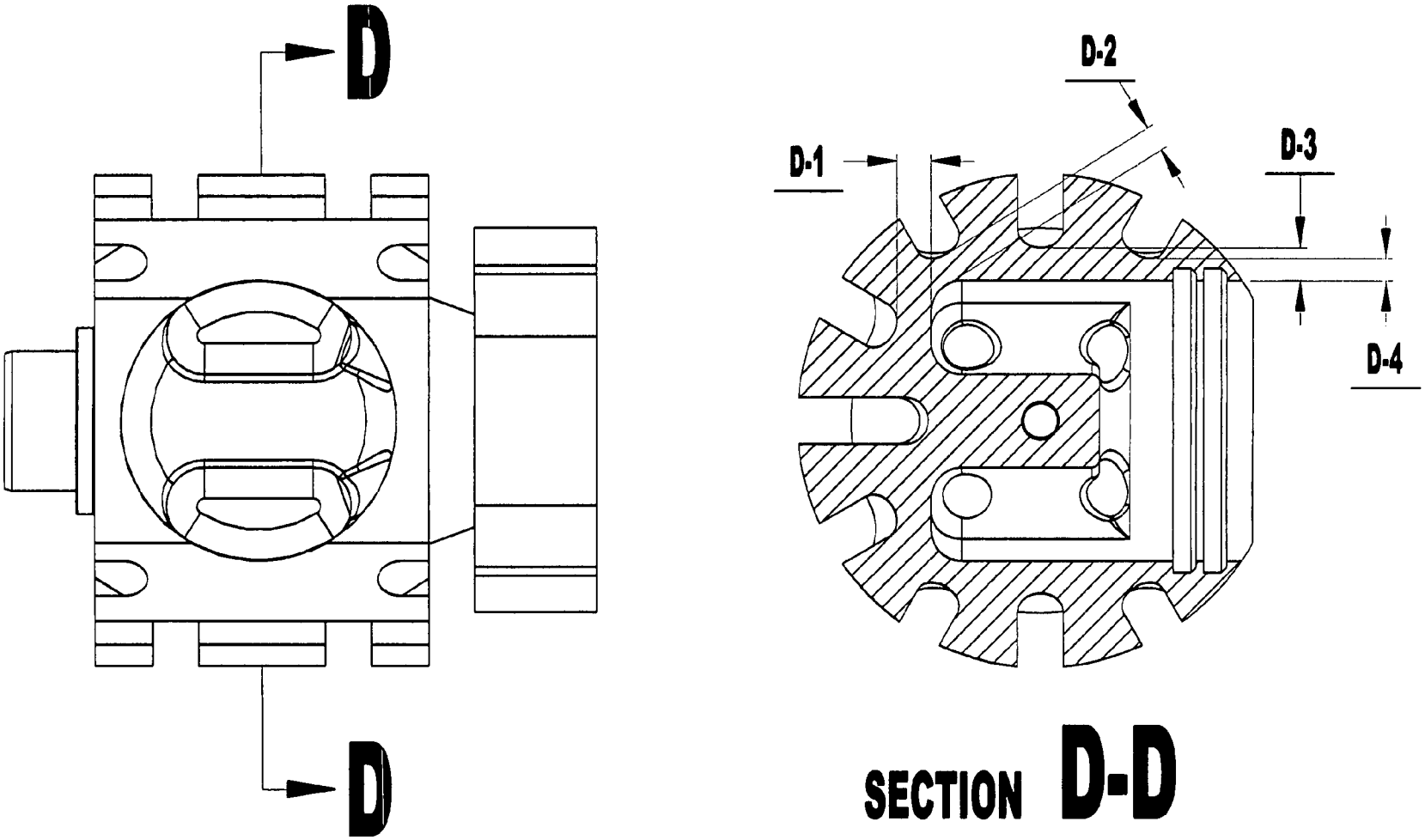
FIG. 15 includes a bottom view of the combustion head of FIG. 4 showing section line D-D and a cross-sectional view of the combustion head of FIG. 4 taken at the line D-D.

Referring to FIG. 15, the illustrated embodiment of the combustion head 18 includes a wall thickness of substantially the same dimension at the coolant channels 64 throughout the length of the combustion head. The illustrated embodiment of the combustion head 18 includes the following wall thicknesses at section D-D:

D-1=0.141 inches
D-2=0.105 inches
D-3=0.131 inches
D-4=0.088 inches.

Thus, in the illustrated embodiment, the sidewalls of the body portion 19 of the combustion head 18 formed between the interior chamber 23 and the plurality of longitudinal coolant channels 64 have a wall thickness in a range of about 0.088 inches to about 0.141 inches with an average wall thickness of about 0.116 inches.

In a more preferred embodiment of the present invention combustion head 18, the wall thickness of the body portion 19 at the plurality of longitudinal coolant channels 64 averages approximately 0.125 inches.

The substantially uniform wall thickness of the body portion 19 at the longitudinal coolant channels 64 throughout the length thereof allow the combustion head 18 to be maintained at a more uniform operating temperature throughout the mass thereof when compared to prior art combustion heads having much greater variances in the wall thicknesses thereof.

Additionally, the circumferential coolant channels 66 defined by the outer surface of the present invention combustion head 18 further add to the surface area of the outer surface of the combustion head thereby increasing the effect of a coolant passing over the combustion head and allowing the combustion head to operate at lower temperatures than prior art combustion heads. The circumferential coolant channels 66 of present invention combustion head 18 provide an increased heat transfer coefficient for the present invention combustion head compared to prior art combustion heads.

Referring again to FIG. 10, the longitudinal coolant channels 64 of the present invention extend at the first end 40 of the body portion proximate to a shoulder 70 formed around a base of the end portion 38 of the inlet 42 of the material feed conduit 36. The shoulder 70 maintains a space between an inner surface of the housing 12 and the first end 40 of the combustion head when the combustion head is mounted in the housing 12 so that a coolant can pass therebetween.

In the combustion head 18 of the present invention, the end of the coolant channels 64 near the inlet 42 of the material feed conduit 36 ensure that coolant directly contacts the shoulder 70 formed around the end portion 38 of the material feed conduit. Thus, the shoulder 70 and end portion 38 are maintained at lower operating temperatures than prior art combustion heads wherein the coolant channels do not extend proximate a shoulder of the inlet of the material conduit. Due to the cooler operating temperatures of the end portion 38 of the present invention combustion head, a seal 72 (See FIGS. 3 and 11) disposed between the end portion 38 and the housing 12 is also maintained at lower operating temperatures when used with the present invention combustion head 18 compared to that of the prior art. Accordingly, a seal 72 which often fails due to heat damage in flame spray apparatus employing prior art combustion heads lasts longer and fails less when used with the present invention combustion head. This further adds to the efficiency of the present invention combustion head 18 over those of the prior art.

The flame spray apparatus 10 equipped with the present invention combustion head 18 is used to apply a coating material to a workpiece. In operation, a continuous supply of pressurized fuel mixed with oxygen is ignited in the combustion chamber 20 such that hot pressurized combustion gases discharged from the outlet 26 of the combustion chamber enter the interior chamber 23 of the body portion 19 of the combustion head 18 via the combustion head opening 24. The combustion gases entering the combustion head 18 are forced through the gas conduits 27 and exit through the nozzle 21 of the apparatus at a high velocity. Simultaneously, a supply of pressurized coating material is projected through the material conduit 36.

Upon exiting the combustion head 18 through the nozzle 21, the coating material is enveloped by the combustion gases exiting the gas conduits 27 which propel the coating material through the throat of the nozzle.

The foregoing description of embodiments of the present invention have been presented for the purpose of illustration and description and are not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A combustion head for use with a flame spray apparatus having a combustion chamber from which pressurized combustion gases are discharged, and a nozzle from which coating materials heated by the combustion gases are projected, the combustion head comprising:

a body portion defining a combustion opening for receiving an outlet end of the combustion chamber, the body portion further defining an interior chamber extending along an axis from the combustion opening into the body portion, the axis of the combustion chamber being oriented substantially perpendicular to a longitudinal axis of the body portion, a material feed conduit extending through said body portion along the longitudinal axis thereof, the material feed conduit having an inlet and an outlet defined by first and second opposed ends of the body portion respectively, the interior chamber extending into the body portion on opposing sides of the material feed conduit, wherein the interior chamber is defined in part by arcuate sidewalls extending from the combustion opening into the body portion beyond the material feed conduit, a plurality of cooling channels defined by an outer surface of the body portion and extending through the length thereof, wherein the cooling channels are spaced radially about the longitudinal axis of the body portion, each of the cooling channels having a varying depth along the length thereof defining an arc corresponding to the arcuate sidewalls of the interior chamber such that the sidewalls of the body portion formed between the interior chamber and the plurality of cooling channels are substantially uniform in wall thickness adjacent the interior chamber, and a plurality of combustion gas conduits extending from the interior chamber through the second end of the body portion and arranged about the material feed conduit.

2. The combustion head according to claim 1 further comprising, the material feed conduit including an end portion at the inlet thereof extending outwardly from the first end of the body portion and configured to pass through a corresponding opening in a housing of the flame spray apparatus, a shoulder formed on the end portion of the material feed conduit adjacent the first end of the body portion, the shoulder defining a surface engageable with an interior wall of the housing for maintaining a space between the body portion of the combustion head and the housing such that a coolant can pass therebetween, the plurality of cooling channels extending through the first end of the body portion proximate the shoulder for cooling the shoulder and thereby the inlet of the material feed conduit for extending the life of a seal disposed between the inlet of the material feed conduit and the housing.

3. The combustion head according to claim 2 wherein the plurality of cooling channels extend through the first end of the body portion to an outer surface of the shoulder.

4. The combustion head according to claim 1 further comprising at least one cooling channel defined by an outer surface of the body portion and extending circumferentially about the longitudinal axis of the body portion.

5. The combustion head according to claim 1 further comprising a flange coupled to the second end of the body portion for receiving a nozzle.

6. The combustion head according to claim 1 wherein the sidewalls of the body portion formed between the interior chamber and the plurality of cooling channels have a wall thickness in a range of about 0.088 inches to about 0.141 inches.

7. The combustion head according to claim 1 wherein the sidewalls of the body portion formed between the interior chamber and the plurality of cooling channels have an average wall thickness of about 0.125 inches throughout the length of the body portion adjacent the interior chamber.

8. The combustion head according to claim 1 further comprising a plurality of O-rings within the combustion head opening for receiving the outlet end of the combustion chamber.

9. The combustion head according to claim 1 wherein the body portion defining the combustion opening has a substantially flat exterior wall engageable with a flange on the outer circumferential surface near the outlet end of the combustion chamber, such that proper coupling between the combustion head and the combustion chamber can be confirmed, when the flange is seated on the flat exterior wall.

10. A combustion head and combustion chamber assembly for use with a flame spray apparatus, the assembly comprising:

a body portion defining a combustion opening for receiving an outlet end of the combustion chamber, the body portion further defining an interior chamber extending along an axis from the combustion opening into the body portion, the axis of the combustion chamber being oriented substantially perpendicular to a longitudinal axis of the body portion, a material feed conduit extending through said body portion along the longitudinal axis thereof, the material feed conduit having an inlet and an outlet defined by first and second opposed ends of the body portion respectively, the interior chamber being defined in part by opposing arcuate sidewalls and extending continuously from the combustion opening into the body portion on opposing sides of the material feed conduit, a plurality of cooling channels defined by an outer surface of the body portion and extending through the length thereof, the cooling channels spaced radially about the longitudinal axis of the body portion, wherein the plurality of cooling channels each have a varying depth along the length thereof defining an arc corresponding to the arcuate sidewalls of the interior chamber such that the sidewalls of the body portion formed between the interior chamber and the plurality of cooling channels are substantially uniform in wall thickness adjacent the interior chamber, a plurality of combustion gas conduits extending from the interior chamber through the second end of the body portion and arranged about the material feed conduit, a combustion chamber having an outlet end thereof removably inserted into the combustion opening, the combustion chamber having a flange formed on an outer surface thereof engageable with an outer surface of the combustion head for limiting the insertion of the combustion chamber into the combustion opening.

11. The combustion head and combustion chamber assembly according to claim 10 wherein the body portion is substantially hollow, the interior chamber defined by the body portion extending from the combustion opening throughout substantially the entire body portion including adjacent the material feed conduit.

12. The combustion head and combustion chamber assembly of claim 10 wherein the flange formed on an outer surface of the combustion chamber restricts the insertion of the combustion chamber into the combustion head such that a space is maintained between the outlet end of the combustion chamber and an outer surface of the material feed conduit.

13. The combustion head and combustion chamber assembly according to claim 10 further comprising, the material feed conduit including an end portion at the inlet thereof extending outwardly from the first end of the body portion and configured to pass through a corresponding opening in a housing of the flame spray apparatus, a shoulder formed on the end portion of the material feed conduit adjacent the first end of the body portion, the shoulder defining a surface engageable with an interior wall of the housing for maintaining a space between the body portion of the combustion head and the housing such that a coolant can pass therebetween, the plurality of cooling channels extending through the first end of the body portion proximate the shoulder for cooling the shoulder and thereby the inlet of the material feed conduit.

14. The combustion head according to claim 10 further comprising a plurality of O-rings coupled within the combustion head opening for receiving the outlet end of the combustion chamber.

15. The combustion head according to claim 10 wherein the body portion defining the combustion opening has a substantially flat exterior wall engageable with a flange on the outer circumferential surface near the outlet end of the combustion chamber, such that proper coupling between the combustion head and the combustion chamber can be confirmed, when the flange is seated on the flat exterior wall.

* * * * *